US007567215B1

(12) United States Patent
All et al.

(10) Patent No.: US 7,567,215 B1
(45) Date of Patent: Jul. 28, 2009

(54) PORTABLE AND INFLATABLE ANTENNA DEVICE

(75) Inventors: Christopher D. All, Charleston, SC (US); Jamin E. Barnett, Goose Creek, SC (US); Robert A. Taylor, Goose Creek, SC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 76 days.

(21) Appl. No.: 11/877,055

(22) Filed: Oct. 23, 2007

(51) Int. Cl.
*H01Q 1/08* (2006.01)
*H01Q 15/20* (2006.01)

(52) U.S. Cl. ..... 343/881; 343/915

(58) Field of Classification Search ..... 343/872, 343/878, 880, 881, 915
See application file for complete search history.

(56) References Cited

U.S. PATENT DOCUMENTS 3,005,987 A * 10/1961 Mack et al. ..... 343/872
6,650,304 B2 * 11/2003 Lee et al. ..... 343/915
6,963,315 B2 * 11/2005 Gierow et al. ..... 343/872
7,382,332 B2 * 6/2008 Essig et al. ..... 343/878

* cited by examiner

*Primary Examiner*—Shih-Chao Chen
(74) *Attorney, Agent, or Firm*—Ryan J. Friedl; Kyle Eppele

(57) ABSTRACT

An inflatable antenna may include a support structure comprised of a flexible material, the support structure having an inner wall and an outer wall, the inner wall and the outer wall defining an inflation region; a flexible antenna element contained within the support structure; a feed line and a phase line connected to the flexible antenna element; an inflatable bladder contained within the inflation region; and an inflation apparatus coupled to the support structure and in fluid communication with the inflatable bladder. In some embodiments, the inflatable bladder may be readily inserted and removed from the support structure through an opening within the support structure. The inflatable antenna may operate in the UHF satellite communications band. The feed line and phase line may be perpendicularly oriented with respect to the flexible antenna element. In some embodiments, the support structure may not include an inner wall.

20 Claims, 8 Drawing Sheets

10
21
27
34
22
30
28
23
25
50
70
32
40
30
26
38
24
36
25

PORTABLE AND INFLATABLE ANTENNA DEVICE

FEDERALLY-SPONSORED RESEARCH AND DEVELOPMENT

The Portable and Inflatable Antenna Device was developed with Federal funds and is assigned to the United States Government. Licensing and technical inquiries may be directed to the Office of Patent Counsel, Space and Naval Warfare Systems Center, San Diego, Code 360012, San Diego, Calif., 92152; telephone (619) 553-3001, facsimile (619) 553-3821. Reference Navy Case No. 98664.

BACKGROUND OF THE INVENTION

Communication via ultra-high frequency satellite systems (UHF SATCOM) and mobile user objective systems (MUOS) has become more portable due to the development of portable radios that support such waveforms. To fully utilize such portable systems, corresponding antennas must also be portable. However, current antennas are not highly portable, as they are often heavy, bulky, and comprised of rigid materials. Such antennas tend to be costly and cannot easily be packed and deployed by a user due to the use of rigid structures within the antenna. Therefore, there is a current need for a portable antenna that is inexpensive, small, lightweight, flexible, durable, and can be readily deployed.

DETAILED DESCRIPTION OF SOME EMBODIMENTS

Figure 1:
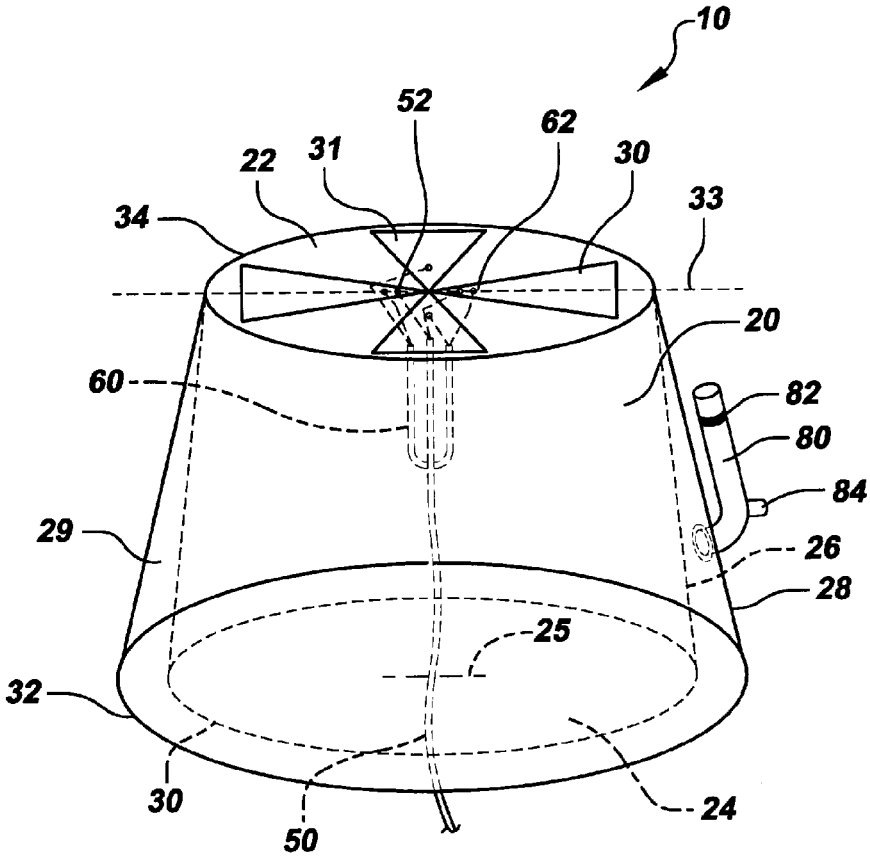
FIG. 1 shows a front perspective view of an embodiment of the portable and inflatable antenna device.
Figure 2:
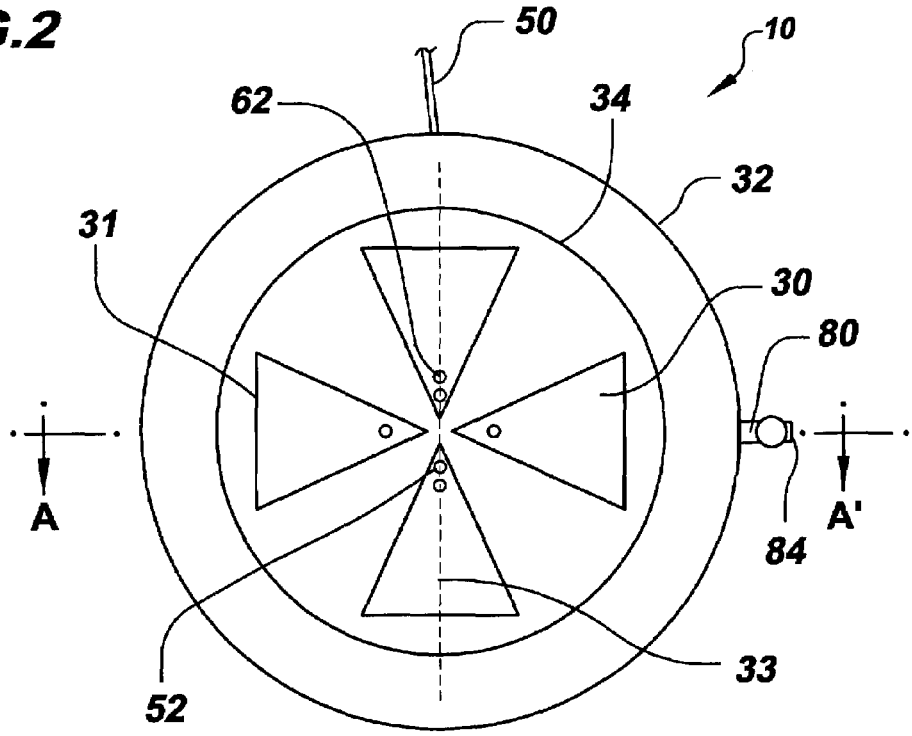
FIG. 2 shows a top view of an embodiment of the portable and inflatable antenna device.
Figure 3:
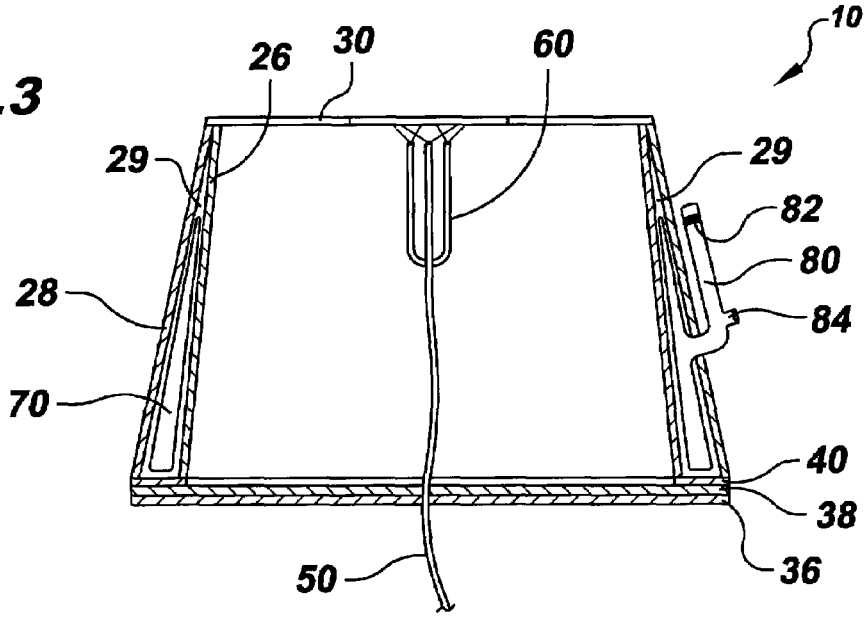
FIG. 3 shows a cross-section view of an embodiment of the portable and inflatable antenna device.
Figure 4:
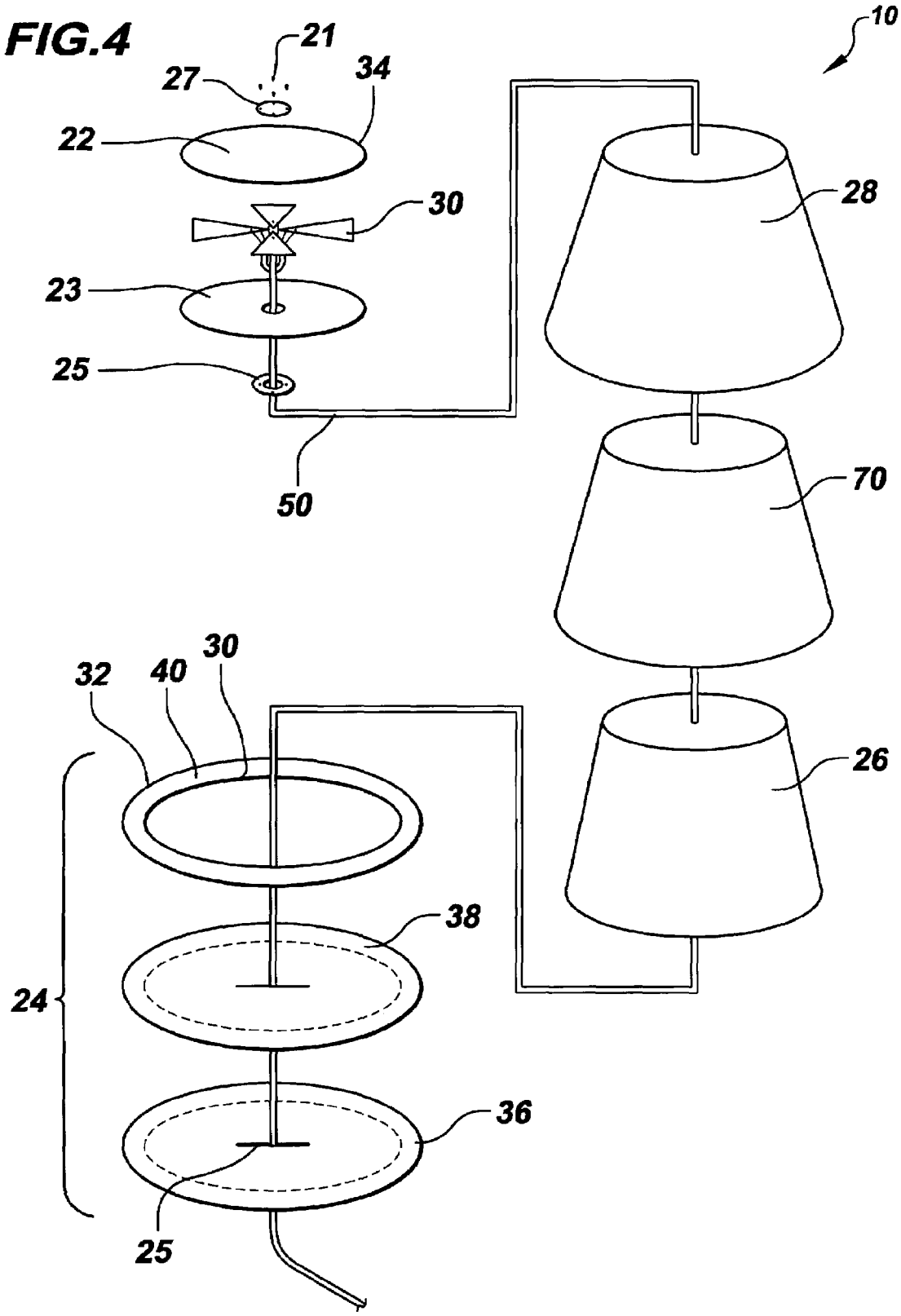
FIG. 4 shows an exploded view of an embodiment of the portable and inflatable antenna device.
Figure 5:
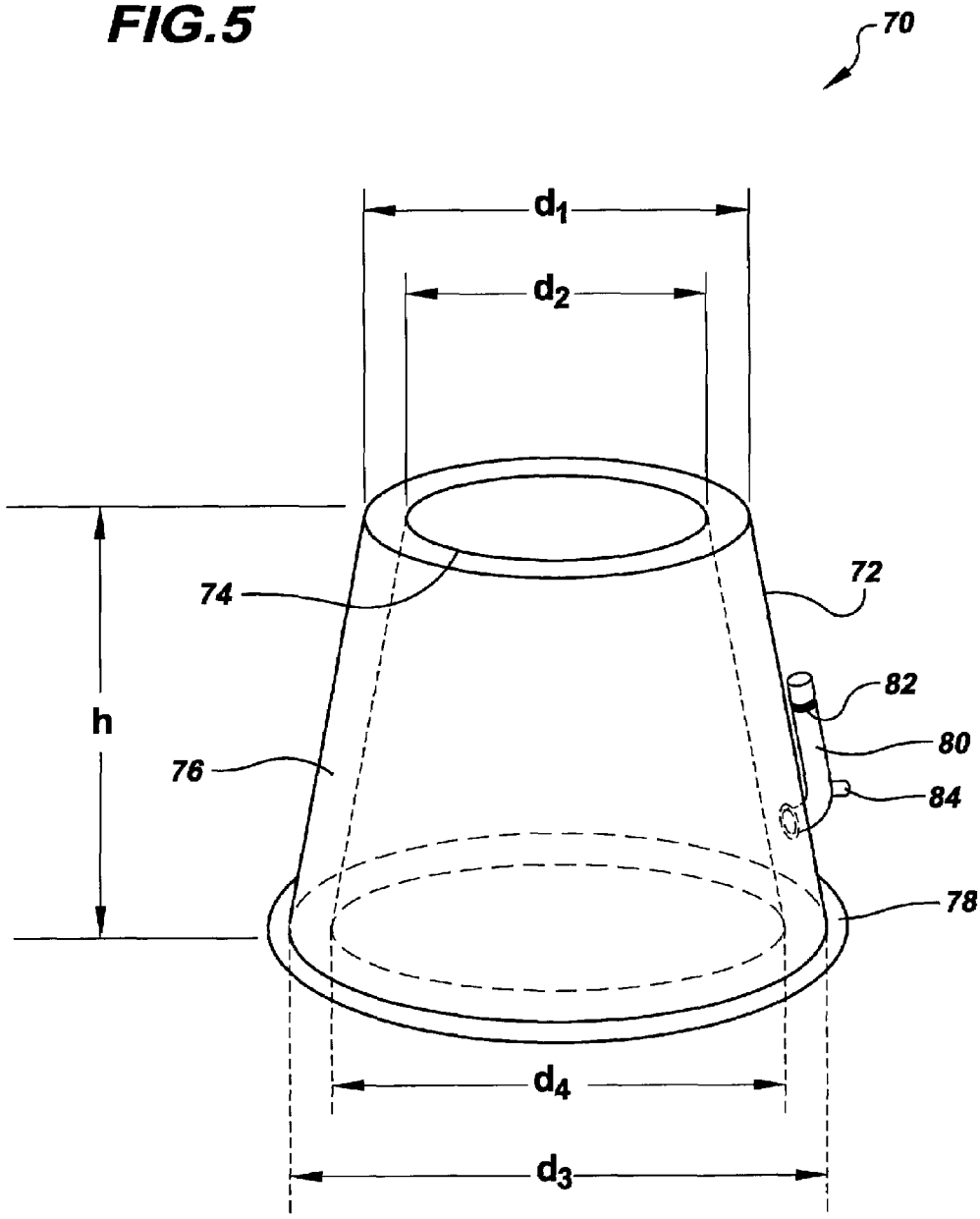
FIG. 5 shows a front perspective view of the inflatable bladder portion of an embodiment of the portable and inflatable antenna device.

Referring to FIGS. 1-5, there is shown an embodiment of the portable and inflatable antenna device 10. Antenna 10 may include a support structure 20, a flexible antenna element 30, a feed line 50, a phase line 60, an inflatable bladder 70 (see FIG. 3), and an inflation apparatus 80. Antenna 10 may be configured to operate in various frequency bands. As an example, antenna 10 may be configured to operate in the ultra-high frequency satellite communications (UHFSATCOM) band and may have an approximate gain of 5 dBi over such band. Antenna 10 may be configured to have various polarizations, such as right-hand circular, left-hand circular, vertical, or horizontal.

Support structure 20 may be comprised of a flexible material, such as nylon. In some embodiments, support structure 20 may be substantially cylindrical in shape. As an example, support structure 20 may have a diameter of 40 cm and a height of 24 cm. In some embodiments, support structure 20 may comprise a circular top portion 22 and a circular bottom portion 24 coupled to top portion 22 by an inner wall 26 and an outer wall 28. Bottom portion 24 may have an inner circumference 30 and an outer circumference 32, where outer circumference 32 is greater than the circumference 34 of top portion 22. Inner wall 26 may be attached to circumference 34 of top portion 22 and inner circumference 30. Outer wall 28 may be attached to the circumference 34 and outer circumference 32. Outer wall 28 may be comprised of a flexible, substantially water-proof, and non-conductive fabric, such as nylon. In some embodiments, a conductive fabric (not shown) may be sewn to the inner surface of outer wall 28 to increase the conductivity of antenna 10.

Inflatable bladder 70 may be contained within support structure 20. In some embodiments, inflatable bladder 70 may be contained within an inflation region 29, which may be defined by inner wall 26 and outer wall 28. Inflation region 29 allows for antenna 10 to be inflated with a minimal amount of breaths required. Inflatable bladder 70 may be comprised of a flexible material, such as urethane. Inflatable bladder 70 may have an outer wall 72 having an upper diameter $d_1$ and a lower diameter $d_3$, and an inner wall 74 having an upper diameter $d_2$ and a lower diameter $d_4$ (see FIG. 5). Inflatable bladder 70 may have a height h. As an example, $d_1$ may be 32 cm, $d_2$ may be 17 cm, and h may be 24 cm. In some embodiments, inflatable bladder 70 may have the same general shape as support structure 20. In some embodiments, outer wall 72 may be attached to outer wall 28 and inner wall 74 may be attached to inner wall 26, by such means as sewing or gluing. In some embodiments, the inflatable bladder may be removable from the support structure (see FIGS. 9 and 10). Outer wall 72 and inner wall 74 define a region 76 for receiving air to inflate inflatable bladder 70. In other embodiments, inflatable bladder 70 may comprise various shapes, such as cylindrical (see FIG. 10). In some embodiments, inflatable bladder 70 may contain a lip 78 located along the lower perimeter of outer wall 72 to allow inflatable bladder 70 to be sewn or glued to bottom portion 24 to keep inflatable bladder 70 in place within support structure 20.

Bottom portion 24 may be comprised of a layer of non-conductive material 36, such as nylon, a layer of conductive material 38, such as fabric having conductive fibers, secured to the layer of non-conductive material 36, and a flexible ring structure 40 secured to the layer of conductive material 38. This construction allows for antenna 10 to be protected by layer of non-conductive material 36 when antenna 10 is rolled up. Bottom portion 24 may have sealable opening 25 therein, within inner circumference 30, wherein feed line 50 is disposed through sealable opening 25. Sealable opening 25 may be opened/closed by the use of Velcro®, a zipper, or other conventional means as recognized by one having ordinary skill in the art.

Feed line 50 and phase line 60 may be connected to flexible antenna element 30. As an example, feed line 50 and phase line 60 may be soldered to flexible antenna element 30. In embodiments wherein the antenna includes a printed circuit board to which the flexible antenna element is attached (see FIG. 8), the feed line and the phase line may be soldered to the printed circuit board. In such embodiments, the feed line and the phase line may be soldered such that they are positioned perpendicular to the flexible antenna element. In the embodiments where feed line 50 and phase line 60 are connected to flexible antenna element 30, at least one of the feed line connections 52 and at least one of the phase line connections 62 may be aligned along a centerline 33 of flexible antenna element 30. This alignment helps to optimize impedance matching and gain characteristics of antenna 10.

Feed line 50 and phase line 60 may be coupled to support structure 20 to give antenna 10 a right-hand circular polarization. However, in other embodiments, feed line 50 and phase line 60 may be coupled to support structure 20 such that antenna 10 contains a different polarization, such as left-hand circular, vertical, or horizontal. Feed line 50 may have a ¼ wavelength sleeve balun (not shown) attached thereto. As an example, if the center frequency is 300 MHz, the wavelength will be 100 cm. Thus, the sleeve balun would be 25 cm. The length of feed line 50 may be determined by multiplying the velocity factor of feed line 50 by ¼ the wavelength of the center frequency of antenna 10. As an example, the velocity factor of feed line 50 may be RG-174. The length of phase line 60 may be determined by multiplying the velocity factor of phase line 60 by ¼ the wavelength of the center frequency of antenna 10. As an example, the velocity factor of RG-62 phase line cable is 0.85, therefore for a center frequency of 300 MHz, the phase line 60 will be of length 21.3 cm. Phase line 60 may have various lengths depending on the construction of antenna 10.

Flexible antenna element 30 may be coupled to support structure 20. In some embodiments, flexible antenna element 30 is sewn or glued to top portion 22. In some embodiments, flexible antenna element 30 may also be partially coupled to inner wall 26. In some embodiments, support structure 20 may include a flexible element support 23 therein. Flexible element support 23 may have substantially the same shape as top portion 22 and may be sewn or glued around its perimeter to the perimeter of top portion 22, with flexible antenna element being positioned between flexible element support 23 and top portion 22. Flexible element support 23 may serve to increase the durability of the positioning of flexible antenna element 30 within antenna 10 and to allow flexible antenna element 30 to be sealed within support structure 20.

Flexible antenna element 30 may be comprised of any conductive material, such as copper mesh. As an example, in an antenna 10 having a moxon turnstile configuration, flexible antenna element 30 may have a width of between about 2 cm and about 3 cm. In an antenna 10 having a fan turnstile configuration, each triangular element of flexible antenna element 30 may have a size of about 19 cm×19 cm×16.1 cm and may have a thickness of about 0.056 mm. Such a sizing of flexible antenna element 30 gives antenna 10 a frequency range of 230 MHz-350 MHz. The size of antenna element 30 may be larger or smaller depending on the desired frequency range for antenna 10. Flexible antenna element 30 may have a rubber or silicone coating (not shown) to increase its durability.

Flexible antenna element 30 may be coupled to support structure 20 to produce an inflatable antenna having a turnstile moxon rectangle configuration. Such a configuration may allow for an antenna 10 that does not require complex manufacturing, and that has a compact size, a circular polarization, and a slightly directional, broadband design. The moxon rectangle configuration may give antenna 10 a substantially omni-directional beam pattern, with some gain increase when the antenna is directed towards a satellite. An omni-directional pattern allows for use of antenna 10 without requiring knowledge of the satellite position. In other embodiments, flexible antenna element 30 may be coupled to support structure 20 to produce an inflatable antenna having a turnstile fan dipole configuration. Such a configuration may also allow for an antenna 10 that has an omni-directional beam pattern with an increase in gain when directed toward a satellite. In other embodiments, antenna 10 may be configured to have other configurations, such as turnstile yagi and circular-fed quad. In some embodiments, flexible antenna element 30 may be coupled to support structure 20 such that the directivity of antenna 10 is increased. For example, antenna 10 may be configured to have a helix design.

Inflation apparatus 80 may be coupled to inflatable bladder 70, through support structure 20, and may be in fluid communication with inflatable bladder 70 such that air may flow through inflation apparatus 80 into inflatable bladder 70. Inflation apparatus 80 may be a substantially cylindrical tube and may include a one-way inlet valve 82 to prevent air from flowing out of inflatable bladder. Inflation apparatus 80 may also include an outlet valve 84 for allowing air to flow out of inflatable bladder 70. Outlet valve 84 may allow for the rapid deflation of inflatable bladder 70 to allow antenna 10 to be quickly deflated and rolled-up for transport or storage. In some embodiments, outlet valve 84 may be detached from inflation apparatus 80 and may be coupled directly to inflatable bladder 70, extending through support structure 20.

In some embodiments, flexible antenna element 30 may include four antenna elements 31, with each of the antenna elements having a triangular shape. In these embodiments, feed line 50 and phase line 60 may each be connected to at least two of antenna elements 31. Antenna 10 may also include a connection joint support structure contained within support structure 20. The connection joint support structure may comprise a bottom cap 25 coupled to a top cap 27 by fasteners 21, such as screws or rivets. Bottom cap 25 may have an opening therein through which phase line 60 and feed line 50 are disposed, wherein antenna element 30 having phase line 60 and feed line 50 connected thereto is contained between bottom cap 25 and top cap 27. In some embodiments, a printed circuit board may be connected to the flexible antenna element. In such embodiments, the printed circuit board may be located between the bottom cap and the top cap (see, for example, FIG. 8). The connection joint support structure may serve to reduce the stress on the connection joints, which may be soldered, between antenna element 30 and phase line 60 and feed line 50.

Figure 6:
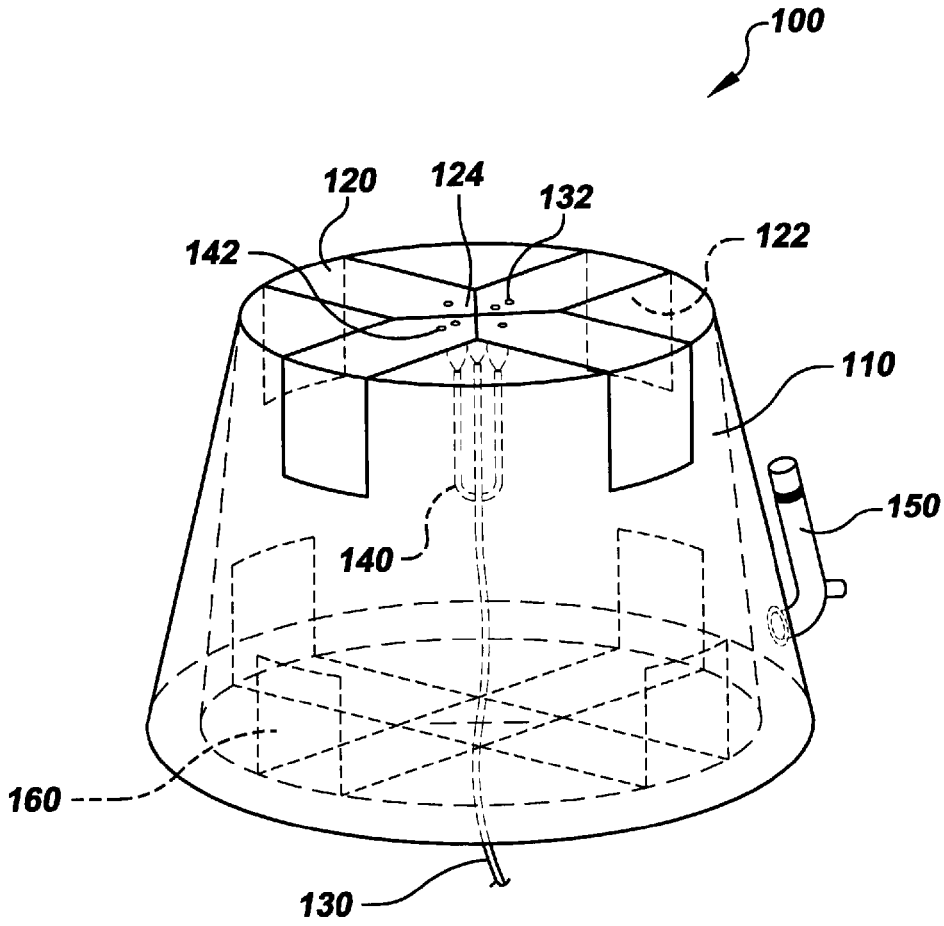
FIG. 6 shows a front perspective view of an embodiment of the portable and inflatable antenna device.

Referring now to FIG. 6, there is shown an embodiment of the portable and inflatable antenna device 100. Antenna 100 may include a support structure 110, a flexible antenna element 120, a feed line 130, a phase line 140, an inflatable bladder (not shown), and an inflation apparatus 150. Support structure 110 may be similar to support structure 20, feed line may be similar to feed line 50, phase line 140 may be similar to phase line 60, and the inflatable bladder may be similar to inflatable bladder 70. Antenna 100 may be configured to operate in various frequency bands. As an example, antenna 100 may be configured to operate in the UHFSATCOM band. Antenna 100 may be configured to have various polarizations, such as right-hand circular, left-hand circular, vertical, or horizontal.

In some embodiments, flexible antenna element 120 may include four antenna elements 122, with each of the antenna elements having a tapered end 124. The tapered ends 124 may have a 45 degree taper, which allows for ends 124 to be positioned substantially adjacent to one another. As an example, tapered ends 124 may be oriented together at the feed line joint with 2 mm of spacing between each tapered end 124. Tapered ends 124 may be secured to support structure 110 substantially adjacent to one another such that the antenna elements form a cross pattern along the top portion of support structure 110. In some embodiments, a second flexible antenna element 160 may be positioned within support structure 110 opposite flexible antenna element 120. Second flexible antenna element 160 may be similar to flexible antenna element 120. Second flexible antenna element 160 may provide the passive reflective element of the moxon antenna array.

Figure 7:
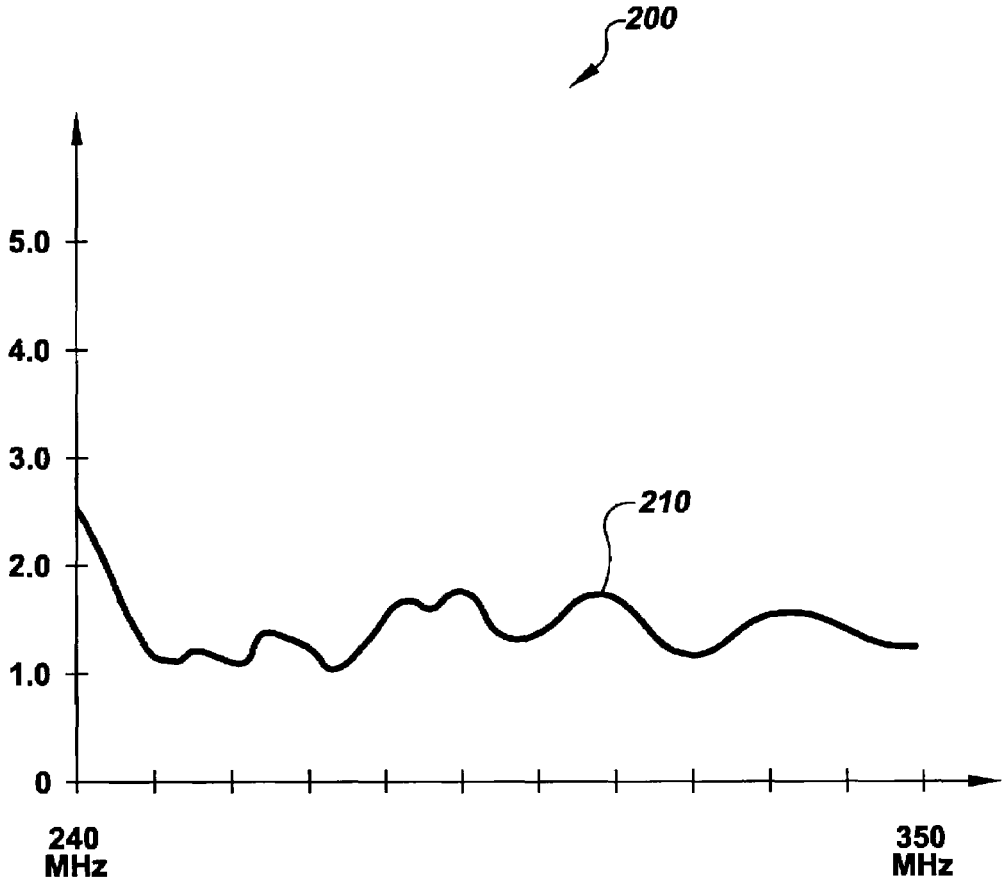
FIG. 7 shows a graph of the voltage standing wave ratio for an embodiment of the portable and inflatable antenna device.

FIG. 7 shows a graph 200 of the voltage standing wave ratio (VSWR) 210 for antenna 10. Graph 200 shows the frequency range of the antenna when matched to a 50 ohm radio system.

Figure 8:
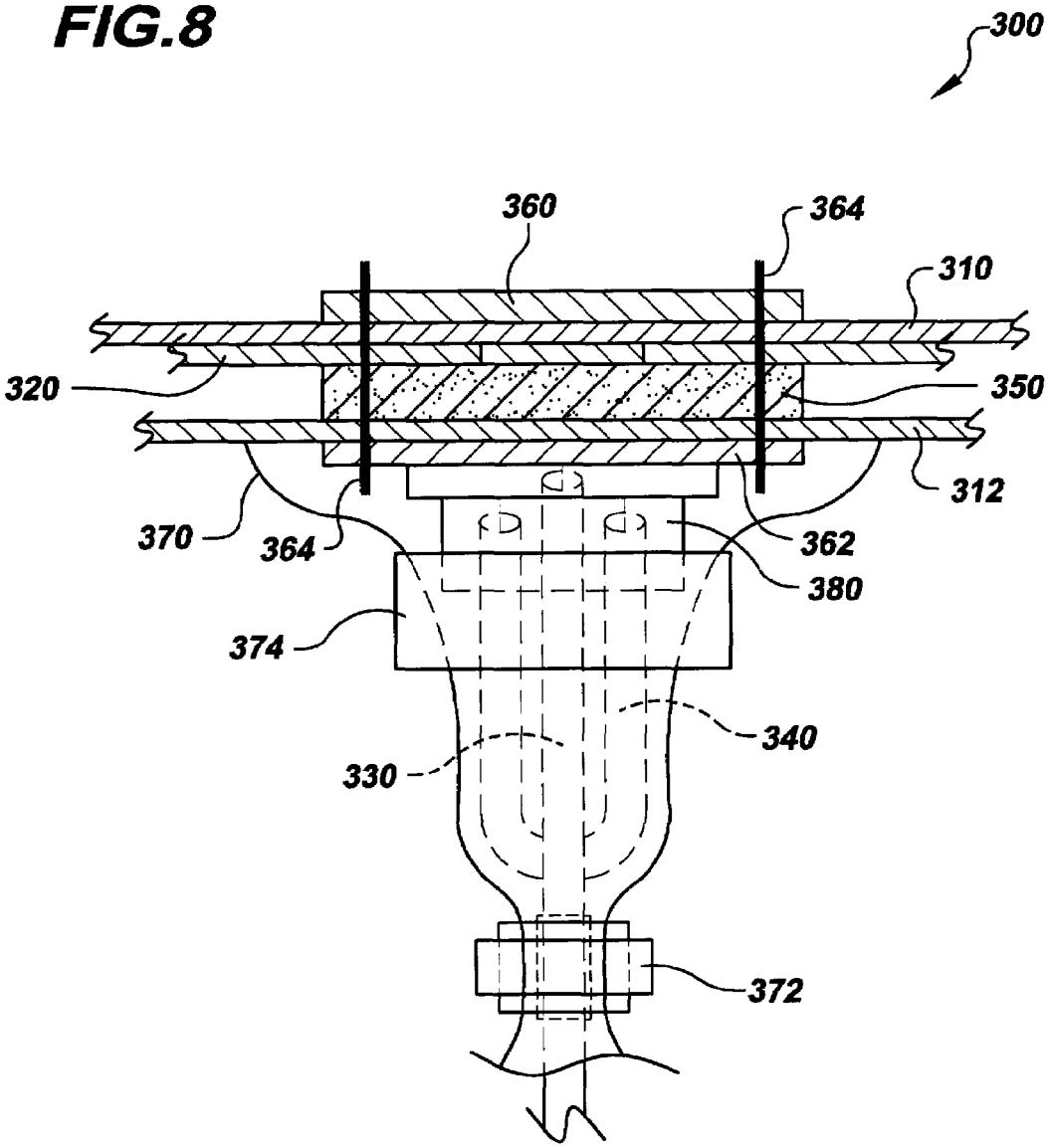
FIG. 8 shows a partial cross-sectional side view of the antenna feed construction an embodiment of the portable and inflatable antenna device.

FIG. 8 shows a side view of the antenna feed construction of an embodiment of the portable and inflatable antenna device 300. Antenna 300 may include a support structure 310, a flexible antenna element 320, a feed line 330, a phase line 340, an inflatable bladder (not shown), and an inflation apparatus (not shown). Antenna 300 may be configured to operate in various frequency bands. As an example, antenna 300 may be configured to operate in the UHFSATCOM band. Antenna 300 may be configured to have various polarizations, such as right-hand circular, left-hand circular, vertical, or horizontal.

Antenna 300 may include a printed circuit board (PCB) 350 within support structure 310. PCB 350 may be positioned between flexible antenna element 320 and a flexible inner support 312. Inner support 312 may be joined around its periphery to the periphery of the top portion of support structure 310, to fully enclose PCB 350 and flexible antenna element 320. Feed line 330 and phase line 340 may be connected to PCB 350 (connections not shown). PCB 350 may be connected to flexible antenna element 320 by heated solder connecting the element to the copper traces on the PCB. The use of PCB 350 enhances the durability of the feed-line to antenna element connection and simplifies the antenna construction and manufacturing process.

Antenna 300 may also include a top cap 360 coupled to support structure 310 and a bottom cap 362 coupled to inner support 312. Top cap 360 may be similar to top cap 27 and bottom cap 362 may be similar to bottom cap 25. Top cap 360 and bottom cap 362 may provide structural support to PCB 350 and flexible antenna element 320. Top cap 360 and bottom cap 362 may be held together by rivets 364, which may extend through openings within bottom cap 362, inner support 312, PCB 350, flexible antenna element 320, support structure 310, and top cap 360. As an example, rivets 364 may be comprised of a flexible material such as nylon. Antenna 300 may also include a flexible support element 370 contained within support structure 310. In some embodiments, flexible support element 370 may comprise a strip of fabric, such as nylon, the ends of which may be sewn, glued, or otherwise coupled to inner support element 312. In other embodiments, flexible support element 370 may be passed through bottom cap 362 and held into place by the compression of bottom cap 362 against inner support element 312 caused by rivets 364. Flexible support element 370 may be positioned around feed line 330 and phase line 340, and secured to feed line 330 by a tie wrap 372. Flexible support element 370 may help support feed line 330 and phase line 340 to relieve the strain on the connection points between PCB 350 and feed line 330 and phase line 340. Antenna 300 may also include a line support 380 coupled to bottom cap 362 to help provide support for feed line 330 and phase line 340 to prevent disconnection of feed line 330 and phase line 340 from PCB 350. As an example, line support 380 may be a rubber grommet. In some embodiments, line support 380 may be coupled to bottom cap 362 through use of glue, screws, or other types of fasteners as would be recognized by one having ordinary skill in the art. In other embodiments, one end of line support 380 may be located between bottom cap 362 and inner support element 312 and held into place by the compression caused by rivets 364. Antenna 300 may also contain a heat shrink 374 to secure feed line 330 and phase line 340 to line support 380.

Figure 9:
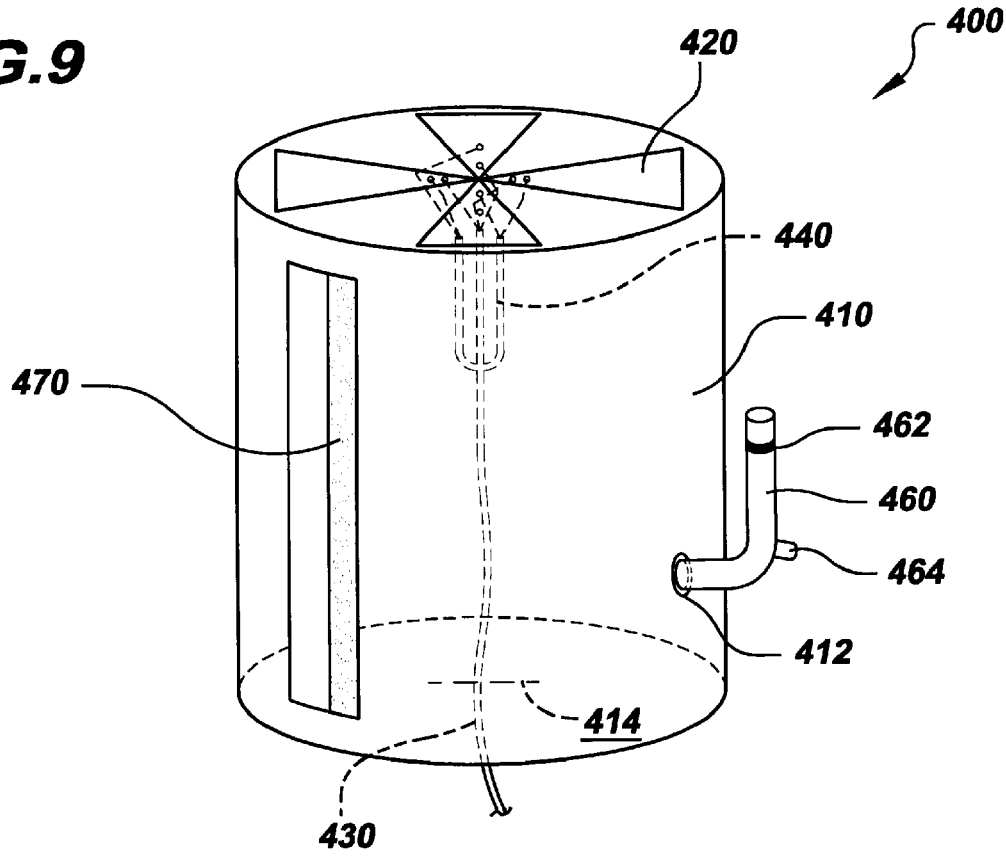
FIG. 9 shows a front perspective view of an embodiment of the portable and inflatable antenna device.
Figure 10:
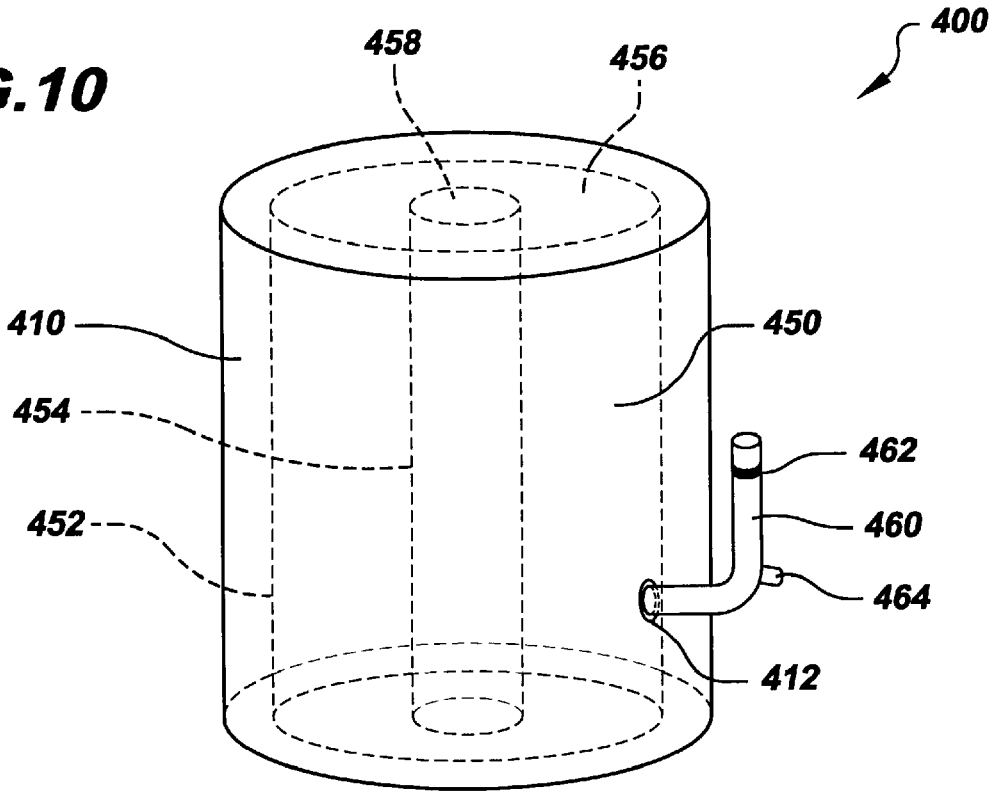
FIG. 10 shows a front perspective view of the inflatable bladder contained within the support structure of an embodiment of the portable and inflatable antenna device.

Referring to FIGS. 9 and 10, FIG. 9 shows a front perspective view of an embodiment of the portable and inflatable antenna device 400. Antenna 400 may include a support structure 410, a flexible antenna element 420, a feed line 430, a phase line 440, an inflatable bladder 450 (see FIG. 10), and an inflation apparatus 460. Support structure 410 may be comprised of a flexible material. Support structure 410 may include an opening (not shown) therein and a closure means 470 for closing the opening, coupled to support structure 410 around the opening. Closure means 470, as well as the opening, may be vertically oriented along support structure 410. As an example, closure means 470 may comprise Velcro® strips, a zipper, buttons, hook and loop fasteners, or snaps. Antenna 400 may be configured to operate in various frequency bands. As an example, antenna 400 may be configured to operate in the UHFSATCOM band. Antenna 400 may have various polarizations, such as circular, vertical, or horizontal.

Inflation apparatus 460 may be coupled to inflatable bladder 450 (see FIG. 10) and may be in fluid communication with inflatable bladder 450 such that air may flow through inflation apparatus 460 into inflatable bladder 450. Inflation apparatus may extend outward from support structure 410 through an opening 412 located within support structure 410. Inflation apparatus 460 may be a substantially cylindrical tube and may include a one-way inlet valve 462 to prevent air from flowing out of inflatable bladder 450. Inflation apparatus 460 may also include an outlet valve 464 for allowing air to flow out of inflatable bladder 450. Outlet valve 464 may allow for the rapid deflation of inflatable bladder 450 to allow antenna 400 to be quickly deflated and rolled-up for transport or storage.

Inflatable bladder 450 may be contained within support structure 410. Inflatable bladder 450 may be inserted or removed from support structure 410 through the opening surrounded by closure means 470. Inflatable bladder 450 may be inserted within support structure 410 by a user opening closure means 470 and placing inflatable bladder 450 within support structure 410. After inflatable bladder 450 is inserted into support structure 410, closure means 470 may be closed to prevent debris from entering into the opening in support structure 410. Inflatable bladder 450 may then be inflated through use of inflation apparatus 460 to give antenna 400 its proper shape for operation. When a user is finished operating antenna 400, the user may deflate inflatable bladder 450 by using outlet valve 464. Inflatable bladder 450 may be comprised of a flexible material, such as urethane. Inflatable bladder 450 may have an outer wall 452 and an inner wall 454. Outer wall 452 and inner wall 454 define a region 456 for receiving air to inflate inflatable bladder 450. Inflatable bladder 450 may be various shapes, such as cylindrical. Inner wall 454 may define a line passage region 458 through which feed line 430 and phase line 440 may pass. Feed line 430, with phase line 440 connected thereto, may be inserted into support structure 410 through opening 414 located at the bottom of support structure 410, then fed through line passage region 458 and coupled to flexible antenna element 420.

Many modifications and variations of the portable and inflatable antenna device are possible in light of the above description. Therefore, within the scope of the appended claims, the portable and inflatable antenna device may be practiced otherwise than as specifically described. Further, the scope of the claims is not limited to the embodiments disclosed herein, but extends to other embodiments as may be contemplated by those with ordinary skill in the art.

We claim:

1. An inflatable antenna comprising:

a support structure comprised of a flexible material, the support structure having an inner wall and an outer wall, the inner wall and the outer wall defining an inflation region;

at least one flexible antenna element contained within the support structure;

a feed line and a phase line connected to the flexible antenna element;

an inflatable bladder contained within the inflation region; and an inflation apparatus coupled to the support structure and in fluid communication with the inflatable bladder such that air may flow through the inflation apparatus into the inflation bladder.

2. The inflatable antenna of claim 1, wherein the feed line and phase line are connected to the flexible antenna element to give the inflatable antenna a right-hand circular polarization.

3. The inflatable antenna of claim 1, wherein the inflatable antenna may be configured to operate in the ultra-high frequency satellite communications band.

4. The inflatable antenna of claim 1, wherein the flexible material is nylon and the inflatable bladder is comprised of urethane.

5. The inflatable antenna of claim 1, wherein the inflation apparatus includes a one-way valve to prevent air from flowing out of the inflatable bladder and an outlet valve for allowing air to flow out of the inflatable bladder.

6. The inflatable antenna of claim 1, wherein the support structure is substantially cylindrical in shape.

7. The inflatable antenna of claim 6, wherein the flexible antenna element includes four antenna elements, each of the antenna elements having a 45-degree tapered end, wherein the tapered ends are secured to the support structure substantially adjacent to one another such that the antenna elements form a cross pattern.

8. The inflatable antenna of claim 1, wherein the flexible antenna element includes four antenna elements, each of the antenna elements having a triangular shape, wherein the feed line and phase line are each connected to at least two of the antenna elements.

9. The inflatable antenna of claim 1, wherein the flexible antenna element is comprised of copper mesh.

10. The inflatable antenna of claim 1, wherein the support structure comprises:

a circular top portion; and a circular bottom portion coupled to the top portion by the inner wall and the outer wall, the bottom portion having an inner circumference and an outer circumference, the outer circumference being greater than the circumference of the top portion, wherein the inner wall is attached to the circumference of the top portion and the inner circumference and the outer wall is attached to the circumference of the top portion and the outer circumference.

11. The inflatable antenna of claim 10, wherein the bottom portion is comprised of a layer of non-conductive material, a layer of conductive material secured to the layer of non-conductive material, and a flexible ring structure secured to the layer of conductive material.

12. The inflatable antenna of claim 1, wherein the support structure includes a bottom portion comprised of a flexible material, the bottom portion having sealable opening therein, wherein the feed line is disposed through the sealable opening.

13. The inflatable antenna of claim 1, wherein at least one of the feed line connections and at least one of the phase line connections are aligned along a centerline of the flexible antenna element.

14. The inflatable antenna of claim 1 further comprising a connection joint support structure coupled to the support structure, the connection joint support structure comprising a bottom cap and a top cap, the bottom cap having an opening therein through which the phase line and the feed line are disposed, wherein the flexible antenna element having the phase line and feed line connected thereto is contained between the bottom cap and the top cap.

15. The inflatable antenna of claim 1, wherein the inflatable bladder includes a lip along the lower perimeter thereof to allow the inflatable bladder to be coupled to the support structure.

16. An inflatable antenna comprising:

a support structure comprised of a flexible material, the support structure comprising a circular top portion, and a circular bottom portion coupled to the top portion by an inner wall and an outer wall, the bottom portion having an inner circumference and an outer circumference, the outer circumference being greater than the circumference of the top portion, wherein the inner wall is attached to the circumference of the top portion and the inner circumference and the outer wall is attached to the circumference of the top portion and the outer circumference, the bottom portion having sealable opening therein;

at least one flexible antenna element contained within the support structure;

a printed circuit board electrically connected to one side of the flexible antenna element;

a feed line connected to the printed circuit board, wherein the feed line is disposed through the sealable opening;

an inflatable bladder contained within the inner wall and outer wall of the support structure, the inflatable bladder having a lip along the lower perimeter thereof to allow the inflatable bladder to be coupled to the bottom portion; and an inflation apparatus coupled to the support structure and in fluid communication with the inflatable bladder such that air may flow through the inflation apparatus into the inflation bladder, the inflation apparatus having a one-way valve to prevent air from flowing out of the inflatable bladder and an outlet valve for allowing air to flow out of the inflatable bladder.

17. An inflatable antenna comprising:

a cylindrical support structure comprised of a flexible material, the support structure having an opening therein;

means, coupled to the opening, for closing the opening;

at least one flexible antenna element contained within the support structure;

a printed circuit board electrically connected to one side of the flexible antenna element;

a feed line and phase line connected to the printed circuit board;

an inflatable bladder contained within the support structure, the inflatable bladder having an outer wall and an inner wall defining an inflation region, the inner wall defining a line passage region through which the phase line and feed line are disposed;

an inflation apparatus coupled to the inflatable bladder and in fluid communication with the inflatable bladder such that air may flow through the inflation apparatus into the inflation bladder, wherein the inflatable antenna is configured to operate in the ultra-high frequency satellite communications band.

18. The inflatable antenna of claim 17, wherein the means for closing the opening is Velcro.

19. The inflatable antenna of claim 17, wherein the flexible antenna element includes four antenna elements, each of the antenna elements having a 45-degree tapered end, wherein the tapered ends are secured to the support structure adjacent to one another such that the antenna elements form a cross pattern.

20. The inflatable antenna of claim 17, wherein the feed line and the phase line are perpendicularly oriented with respect to the flexible antenna element.

* * * * *